US011680446B2

(12) United States Patent
Markku

(10) Patent No.: US 11,680,446 B2
(45) Date of Patent: Jun. 20, 2023

(54) VALVE PILOTING ARRANGEMENTS FOR HYDRAULIC PERCUSSION DEVICES

(71) Applicant: MINCON INTERNATIONAL LIMITED, Shannon (IE)

(72) Inventor: Keskiniva Markku, Ylinen (FI)

(73) Assignee: MINCON INTERNATIONAL LIMITED, Shannon (IE)

( * ) Notice: Subject to any disclaimer, the term of this patent is extended or adjusted under 35 U.S.C. 154(b) by 519 days.

(21) Appl. No.: 16/631,592

(22) PCT Filed: Jul. 17, 2018

(86) PCT No.: PCT/EP2018/069435
§ 371 (c)(1),
(2) Date: Jan. 16, 2020

(87) PCT Pub. No.: WO2019/016231
PCT Pub. Date: Jan. 24, 2019

(65) Prior Publication Data

US 2020/0165871 A1 May 28, 2020

(30) Foreign Application Priority Data

Jul. 20, 2017 (IE) ..... 2017/0149

(51) Int. Cl.
*E21B 1/00* (2006.01)

(52) U.S. Cl.
CPC ..... *E21B 1/00* (2013.01)

(58) Field of Classification Search
CPC ..... E21B 1/00; E21B 4/14; B25D 9/18; F03C 1/0073
See application file for complete search history.

(56) References Cited

U.S. PATENT DOCUMENTS 3,713,367 A * 1/1973 Butterworth ..... F01B 11/04 91/231
4,006,783 A 2/1977 Granholm
4,052,107 A * 10/1977 Hay ..... B25D 9/18 91/308
5,060,734 A 10/1991 Anderson et al.
5,979,291 A * 11/1999 Juvonen ..... B25D 9/18 91/274

FOREIGN PATENT DOCUMENTS

EP 0688636 B1 8/2000
EP 3100829 A1 12/2016

OTHER PUBLICATIONS

International Search Report from corresponding International Patent Application No. PCT/EP2018/069435, dated Oct. 30, 2018.

* cited by examiner

*Primary Examiner* — Taras P Bemko
*Assistant Examiner* — Ronald R Runyan
(74) *Attorney, Agent, or Firm* — Kusner & Jaffe

(57) ABSTRACT

A hydraulic percussion device comprising a piston mounted for reciprocal motion within a cylinder to impact a percussion bit and a control valve to control reciprocation of the piston. A valve pilot line is arranged to switch the control valve based on the position of the piston within the cylinder, wherein the valve pilot line is alternately connected, by the reciprocal movement of the piston, to high and low pressure lines (P, T) via an undercut in the piston. The undercut is located at a portion of the piston having a diameter less than the maximum sealing diameter of the piston.

4 Claims, 6 Drawing Sheets

VALVE PILOTING ARRANGEMENTS FOR HYDRAULIC PERCUSSION DEVICES

FIELD OF THE INVENTION

The invention relates to control or shuttle valve piloting arrangements for hydraulic percussion devices, particularly hydraulic down-the-hole hammers.

BACKGROUND TO THE INVENTION

Hydraulically powered percussion mechanisms are employed in a wide variety of equipment used drill rock. Hydraulic percussion devices, such as that shown in FIG. 1*a*, typically include at least a cylinder 1, a piston 2 mounted for reciprocal motion within the cylinder to impact a percussion bit or tool 3 located at a forward end of the device and a control or shuttle valve 4 to control reciprocation of the piston. The control valve alternately connects a rear driving chamber 6 of the piston to high pressure and low pressure lines P, T of the device to cause the reciprocal movement of the piston. The switching of the control valve is controlled by the position of the piston, that is, position feedback control.

FIG. 1*b* shows the device of FIG. 1*a* in a return stroke, where the piston is being driven away from the tool in the direction shown by the arrow. A valve pilot line 7 is connected to the high pressure line P via an undercut 8 in the piston 2. Hydraulic forces acting on the valve have moved the valve to the right which in turn connects the rear chamber 6 with the low pressure line T. The front chamber 5 is continuously connected to high pressure so that the piston is driven away from the tool 3.

FIG. 1*c* shows the piston in a position in which the undercut 8 in the piston connects the valve pilot line 7 with the low pressure line T, forcing the valve 4 to switch to the left position which in turn connects the rear chamber 6 with the high pressure line P. Since the piston area of the rear chamber is greater than that of the front chamber, the net hydraulic force drives the piston towards the tool 3. Just before the piston impacts the tool, the valve pilot line is once again connected to the high pressure line and the control valve moves to the right to repeat the cycle.

FIGS. 2*a* and 2*b* show a similar concept to FIGS. 1*a* to 1*c*, except that the front chamber 5 is also alternately connected to the high and low pressure lines, similarly to the rear chamber. The valve is piloted in exactly the same manner as described in relation to FIGS. 1*a* to 1*c*.

Percussion devices with valve piloting arrangements as described above in relation to FIGS. 1*a* to 1*c* and FIGS. 2*a* and 2*b* can suffer from substantial internal leakages. The undercut which controls piloting of the valve is located at the largest diameter of the piston, between the front and rear chambers, and leakage is directly proportional to to piston diameter. In addition, the running clearance at the centre of the piston is greater than the bearing clearances $h_b$ at the front and rear bearings to avoid seizing of the piston. Deformation of the cylinder under high pressure will serve to further increase the clearances since the pressure tends to radially expand the cylinder. Typical leakages are shown in FIG. 3. In addition to the leakages at the piston undercut, there will also be leakages from the front and rear chambers to the seal drainage lines 9. The seal drainage lines are provided to improve the longevity of seals 10 since otherwise the seals would be exposed to high pressure.

As a result of these factors, it is difficult to produce a large hydraulic percussion device which can be operated at high pressures without loss of efficiency due to internal leakage.

SUMMARY OF THE INVENTION

According to an aspect of the invention, there is provided a hydraulic percussion device comprising:

- a piston mounted for reciprocal motion within a cylinder to impact a tool such as a percussion bit;
- a control valve to control reciprocation of the piston; and
- a valve pilot line arranged to switch the control valve based on the position of the piston within the cylinder, wherein the valve pilot line is alternately connected, by the reciprocal movement of the piston, to high and low pressure lines via an undercut in the piston, characterised in that the undercut is located at a portion of the piston having a diameter less than the maximum sealing diameter of the piston.

Thus, the diameter of the piston at either side of the undercut is smaller than the maximum sealing diameter of the piston, wherein the maximum sealing diameter of the piston is the largest diameter of the piston which forms a sealing arrangement with the cylinder during normal operation of the device. An advantage of this arrangement is that, because the undercut is located at a portion of the piston having a diameter which is reduced as compared with the maximum sealing diameter of the piston, leakage is reduced.

In one embodiment, the undercut is provided at a rear end of the piston. The undercut may be provided at a portion of the piston which is rearward of the rear chamber during the entire piston cycle. The undercut may be provided at a portion of the piston which is forward of a rear seal during the entire piston cycle.

Typically, the rear end of the piston has a minimum piston diameter. The rear end of the piston typically also has the smallest running clearances. Because of the reduced piston diameter, the cylinder typically has an increased wall thickness in this region, so that the surrounding structure is stiffer. This means that the clearances tend to increase less under pressure. Furthermore, no dedicated seal drainage ports are required, as the cylinder ports that are used to connect the valve pilot line to the low pressure line may also be used to provide seal drainage. Thus, leakage can be minimised by providing the undercut at a rear end of the piston.

In an alternate embodiment, the undercut is provided at a forward end of the piston. The forward end of the piston also has a reduced diameter as compared with a central portion of the piston, thereby reducing leakage.

As used herein, the term "forward" indicates a direction or end of the device of piston which is closest to the percussion bit. The term "rear" is used to indicate a direction or end of the device or piston which is furthest from the percussion bit.

DETAILED DESCRIPTION OF THE DRAWINGS

Figure 1A:
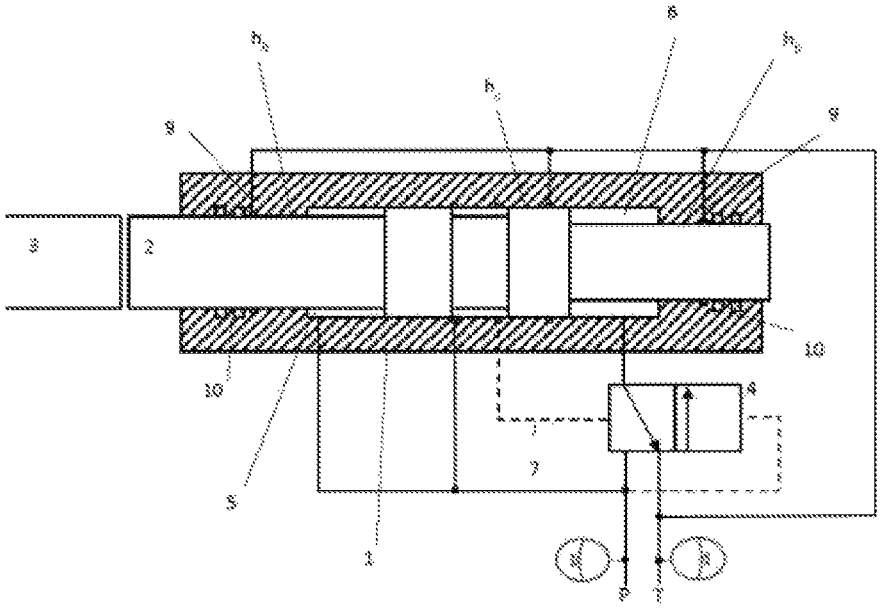
Figure 1a Conventional Art
FIG. 1*a* is a schematic representation of a prior art valve piloting arrangement for a hydraulic percussion device.
Figure 1B:
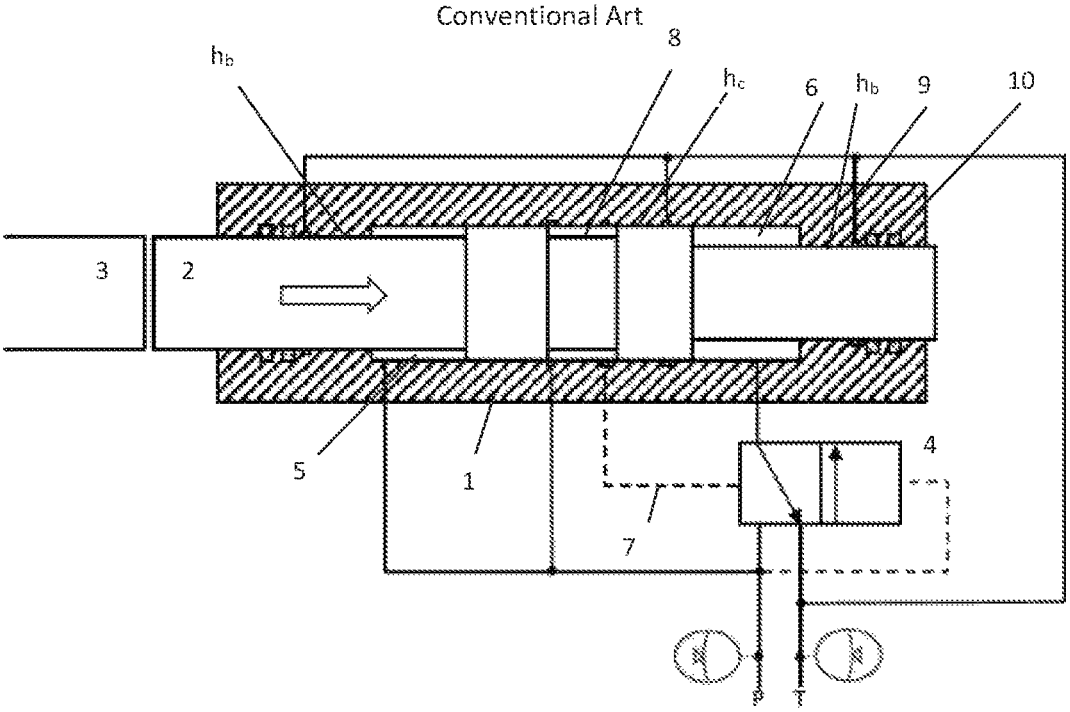
Figure 1b Conventional Art
FIG. 1*b* is a schematic representation of the hydraulic percussion device of FIG. 1*a* in a return stroke.
Figure 1C:
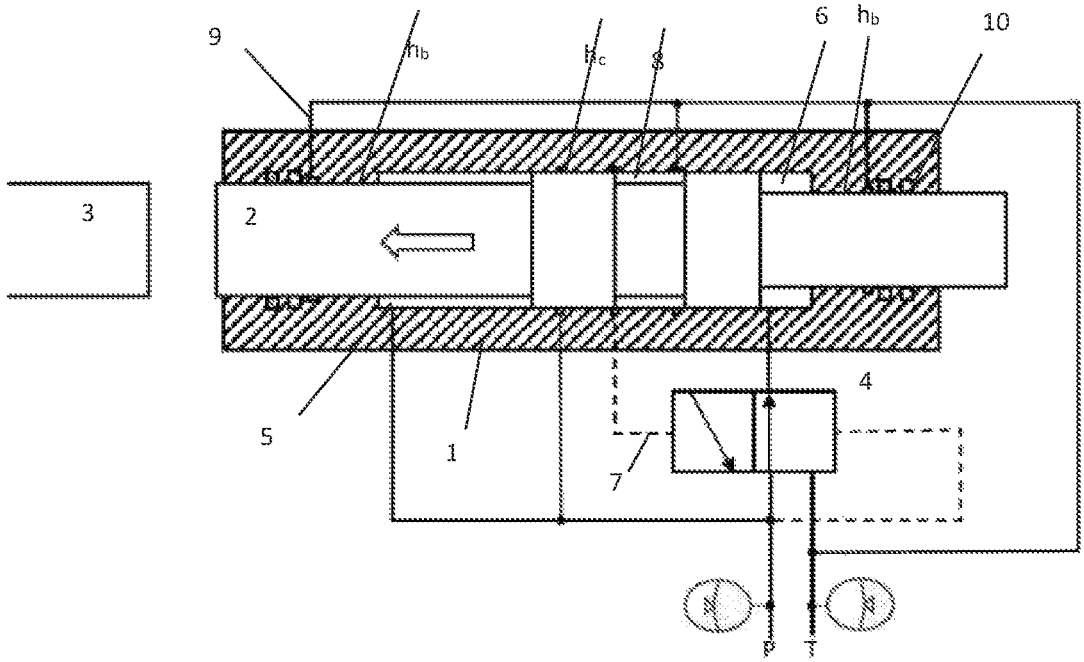
Figure 1c Conventional Art
FIG. 1*c* is a schematic representation of the hydraulic percussion device of FIG. 1*a* at the top of stroke.
Figure 2A:
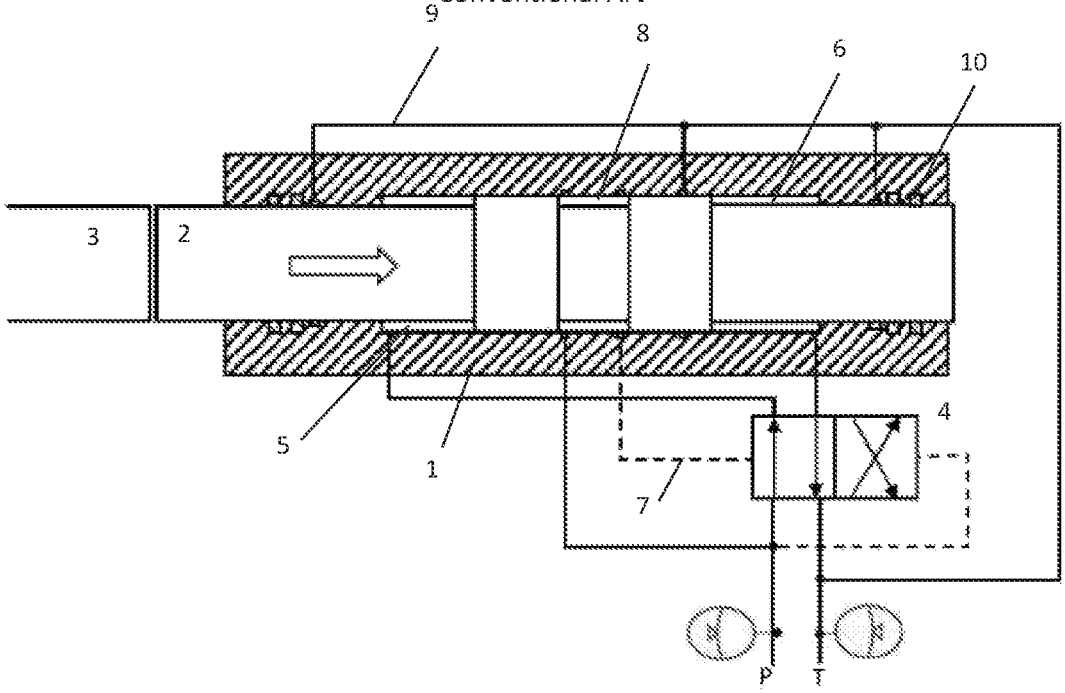
Figure 2a Conventional Art
FIG. 2*a* is a schematic representation of an alternate prior art valve piloting arrangement for a hydraulic percussion device, in which the device is in a return stroke.
Figure 2B:
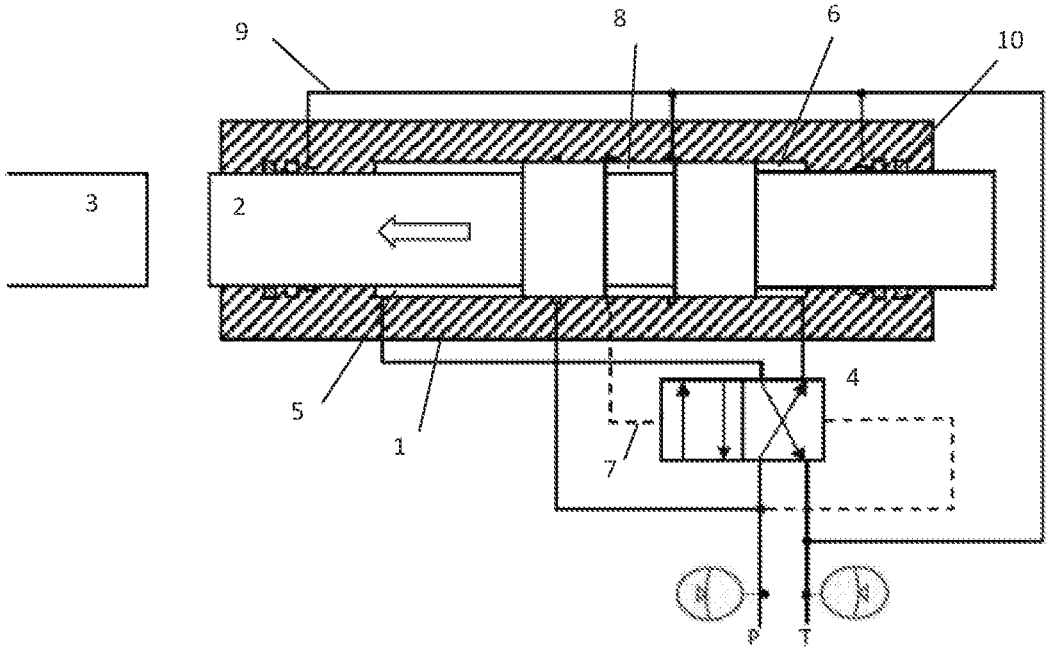
Figure 2b Conventional Art
FIG. 2*b* is a schematic representation of the hydraulic percussion device of FIG. 2*a* at the top of stroke.
Figure 3:
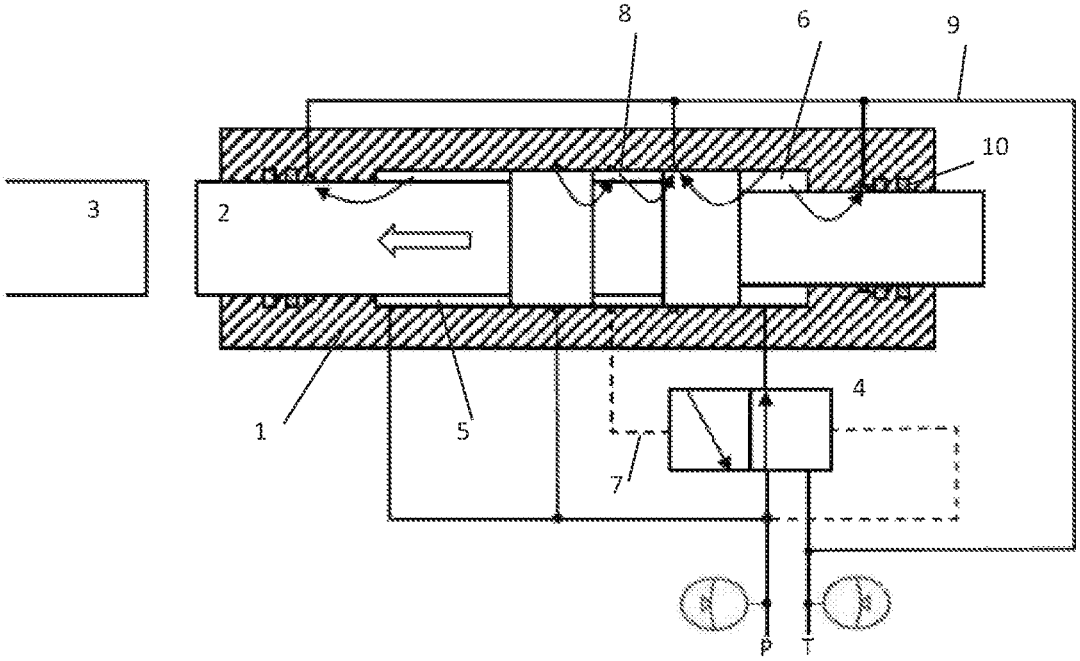
Figure 3 Conventional Art
FIG. 3 is a schematic representation of the hydraulic percussion device of FIG. 1*a* showing typical leakages.
Figure 4A:
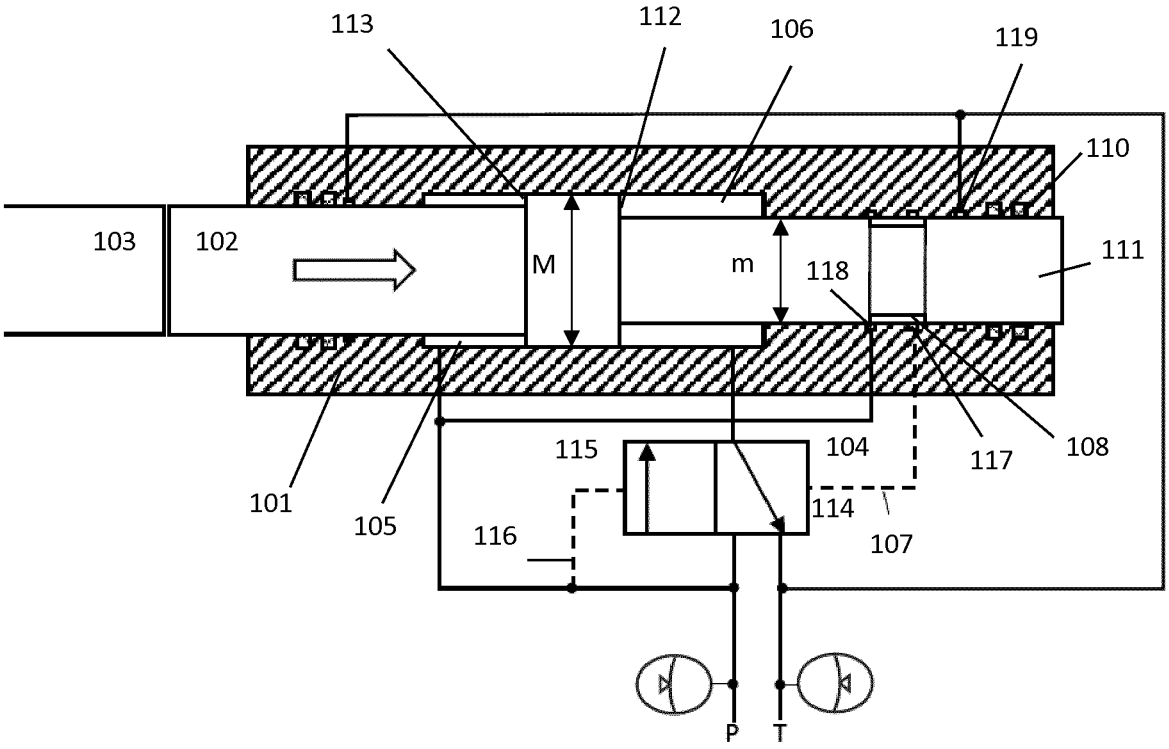
FIG. 4*a* is a schematic representation a valve piloting arrangement for a hydraulic percussion device according to a first embodiment of the invention, in a return stroke.
Figure 4B:
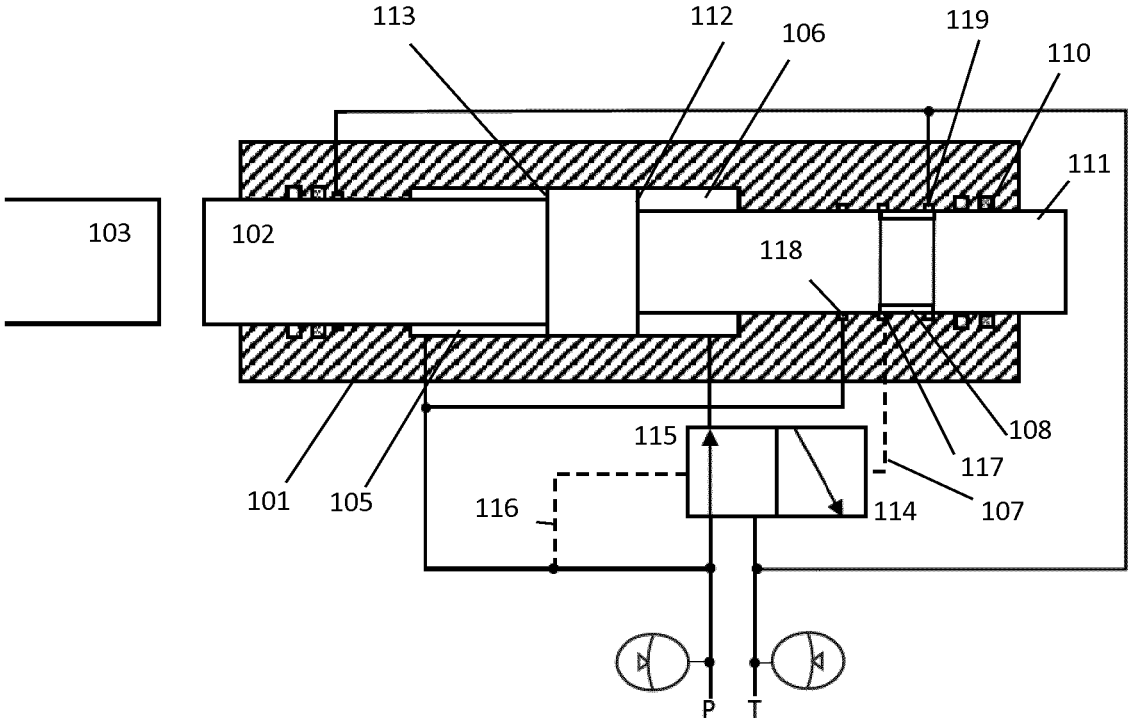
FIG. 4*b* is a schematic representation of the hydraulic percussion device of FIG. 4*a* at the top of stroke.

A valve piloting arrangement for a hydraulic percussion device according to a first embodiment of the invention is illustrated in FIGS. 4*a* and 4*b*. The device comprises a cylinder 101, a piston 102 mounted for reciprocal motion within the cylinder to impact a percussion bit or tool 103 located at a forward end of the device and a control or shuttle valve 104 to control reciprocation of the piston. The control valve alternately connects rear driving chamber 105, 106 of the piston to high pressure and low pressure lines P, T of the device to cause the reciprocal movement of the piston. The switching of the control valve is controlled by the position of the piston, that is, position feedback control. A valve pilot line 107 is arranged to switch the control valve based on the position of the piston within the cylinder.

FIG. 4*a* shows the device in a return stroke, where the piston is being driven away from the tool in the direction shown by the arrow. The valve pilot line 107 is connected between the right side 114 of the valve and an undercut 108 in a rear end of the piston 102, that is, in the piston tail 111. The left side of the valve 115 is connected to the high pressure line P by line 116. As shown in FIG. 4*a*, the portion of the piston at which the undercut 108 is provided has a minimum piston diameter m which is less than the maximum sealing diameter M of the piston.

In FIG. 4*a*, the valve pilot line 107 is connected to the high pressure line P via the undercut 108 and cylinder ports 117 and 118. Because the area on the right side of the valve on which the high pressure acts is greater than that on the left side of the valve, the hydraulic forces acting on the valve have moved the valve to the left which in turn connects the rear chamber 106 with the low pressure line T. The front chamber 105 is continuously connected to high pressure so that the piston is driven away from the tool 103.

As the piston moves to the right, the undercut moves from a position in which it connects the valve pilot line to the high pressure line P, to a position in which it connects the valve pilot line to the low pressure line T. FIG. 4*b* shows the piston in a position in which the undercut 108 in the piston connects the valve pilot line 107 with the low pressure line T via cylinder ports 117 and 119. As the left side 115 of the valve is connected to the high pressure line P, the valve 104 is forced to switch to the right position which in turn connects the rear chamber 106 with the high pressure line P. Since the piston area 112 of the rear chamber is greater than the piston area 113 of the front chamber, the net hydraulic force drives the piston towards the tool 103. Just before the piston impacts the tool, the valve pilot line is once again connected to the high pressure line and the control valve moves to the left to repeat the cycle. As shown in FIGS. 4*a* and 4*b*, the undercut 108 is provided at a portion of the piston which is rearward of the rear chamber 106 during the entire piston cycle. The undercut 108 is provided at a portion of the piston which is forward of a rear seal 110 during the entire piston cycle. Cylinder port 119 provides seal drainage for the rear seals 110, so that no dedicated seal drainage ports are required.

Figure 5A:
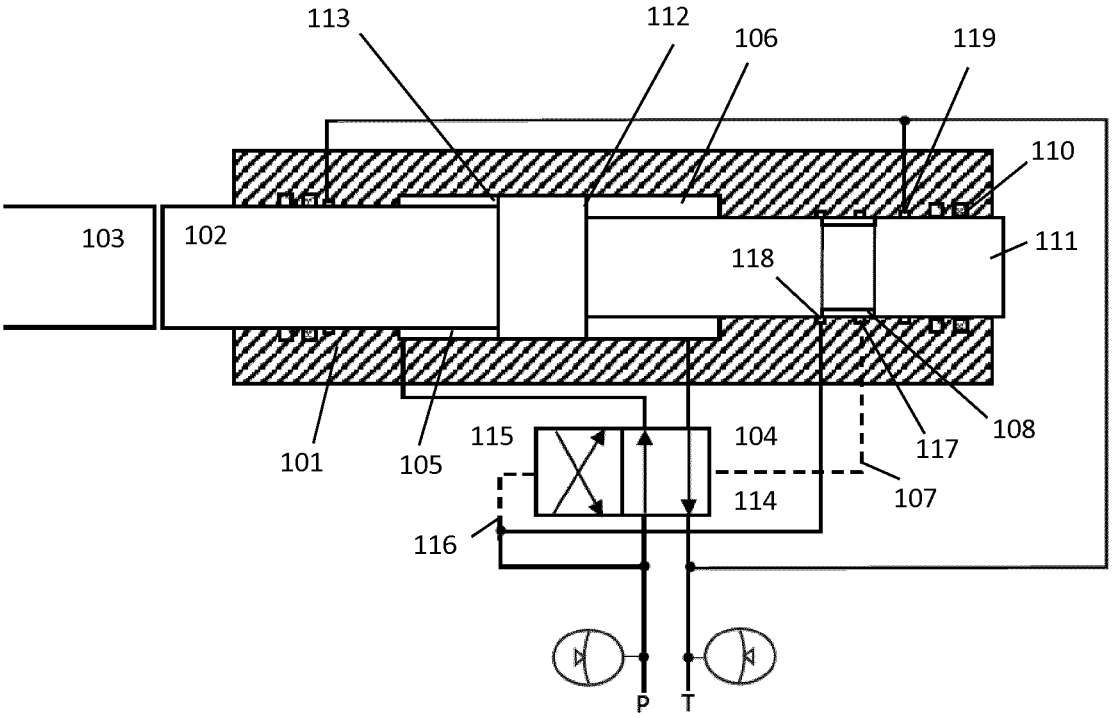
FIG. 5*a* is a schematic representation of a valve piloting arrangement for a hydraulic percussion device according to a second embodiment of the invention, in a return stroke.
Figure 5B:
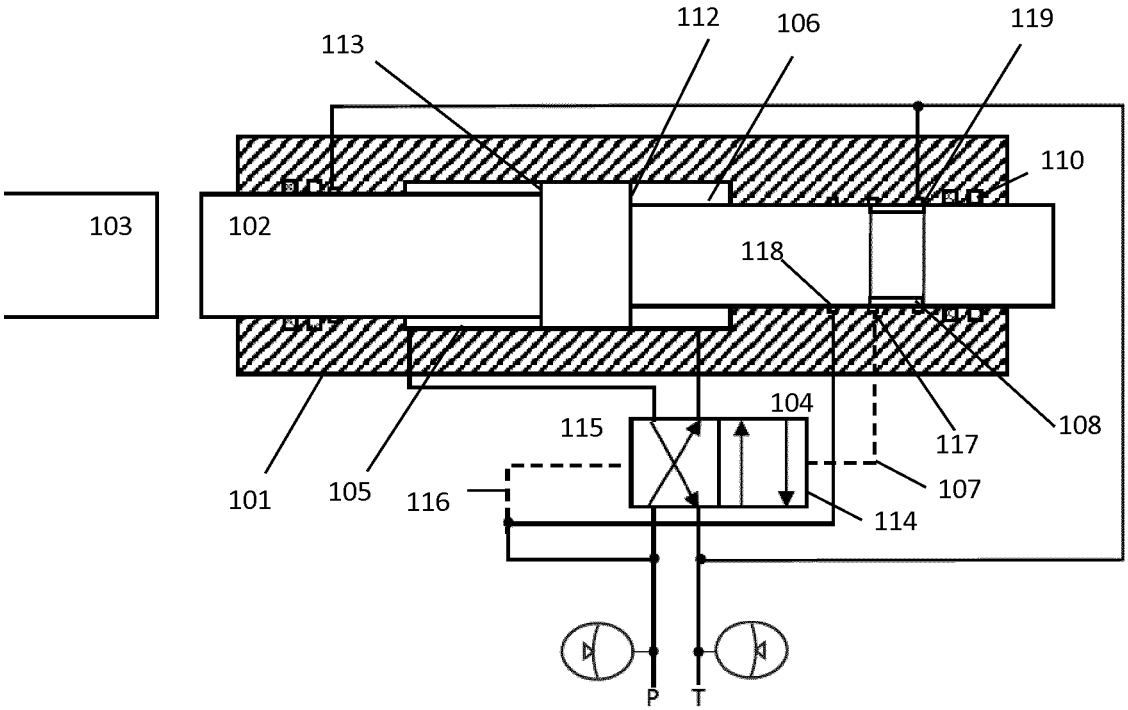
FIG. 5*b* is a schematic representation of the hydraulic percussion device of FIG. 5*a* at the top of stroke.

FIGS. 5*a* and 5*b* show a valve piloting arrangement for a hydraulic percussion device according to a second embodiment of the invention, in which both front and rear chambers have alternating pressures. The valve is piloted in exactly the same manner as described in relation to FIGS. 4*a* and 4*b*.

Figure 6A:
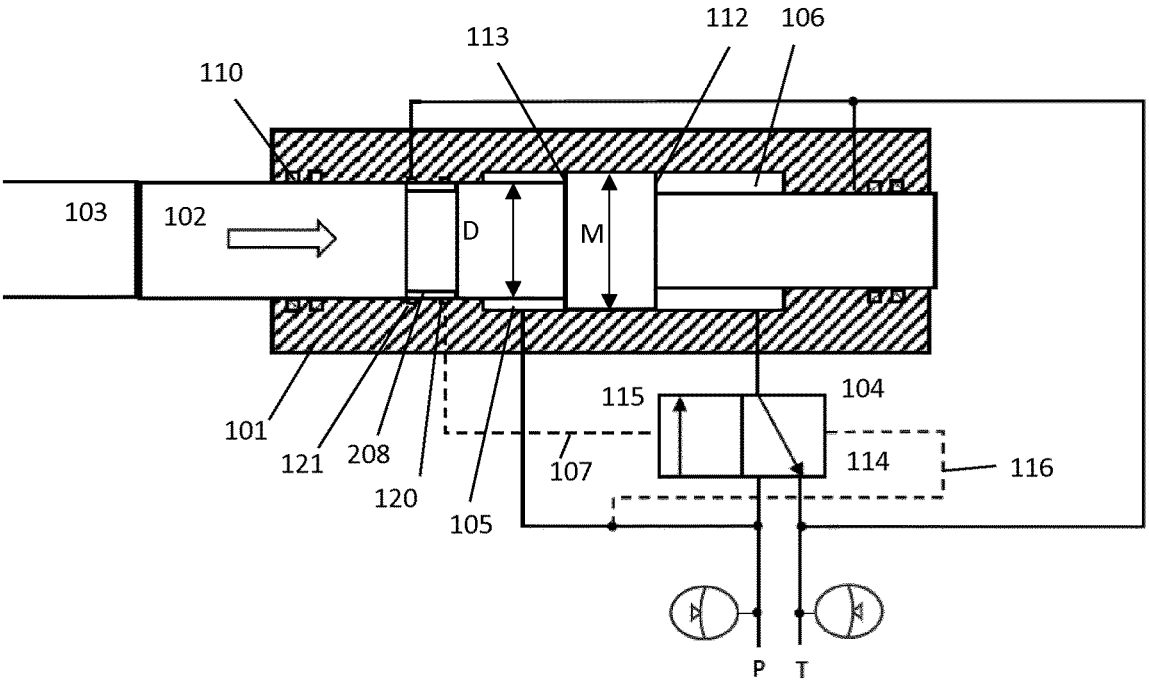
FIG. 6*a* is a schematic representation a valve piloting arrangement for a hydraulic percussion device according to a third embodiment of the invention, in a return stroke.
Figure 6B:
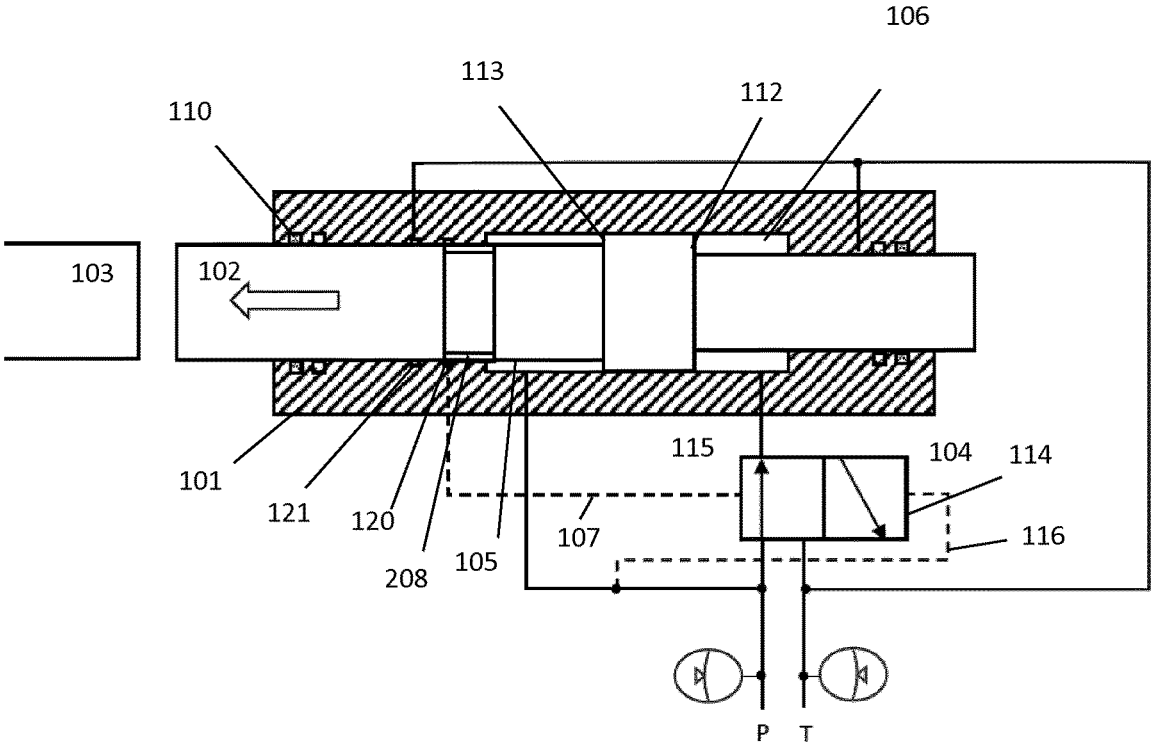
FIG. 6*b* is a schematic representation of the hydraulic percussion device of FIG. 6*a* at the top of stroke.

A third embodiment of the invention is illustrated in FIGS. 6*a* and 6*b*. In this embodiment, the undercut 208 is located at a forward end of the piston. As shown in FIGS. 6*a* and 6*b*, the undercut is located at a portion of the piston having a diameter D which is less than the maximum sealing diameter M of the piston. The valve pilot line 107 is connected between the left side 115 of the valve and the undercut 208 in the forward end of the piston 102. The right side of the valve 114 is connected to the high pressure line P by line 116.

FIG. 6*a* shows the device in a return stroke, where the piston is being driven away from the tool in the direction shown by the arrow. The valve pilot line 107 is connected to the low pressure line T via the undercut 208 in the forward end of the piston 102 and cylinder ports 120 and 121. Hydraulic forces acting on the valve have moved the valve to the left which in turn connects the rear chamber 106 with the low pressure line T. The front chamber 105 is continuously connected to high pressure so that the piston is driven away from the tool 103.

FIG. 6*b* shows the piston in a position in which the undercut 208 in the piston connects the valve pilot line 107 with the high pressure line P via cylinder port 120 and the front chamber, forcing the valve 104 to switch to the right position which in turn connects the rear chamber 106 with the high pressure line P. Since the piston area 112 of the rear chamber is greater than the piston area 113 of the front chamber, the net hydraulic force drives the piston towards the tool 103. Just before the piston impacts the tool, the valve pilot line is once again connected to the low pressure line and the control valve moves to the left to repeat the cycle.

Cylinder port 121 provides seal drainage for the forward seals 110, so that no dedicated seal drainage ports are required.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A hydraulic percussion device comprising:

a piston mounted for reciprocal motion within a cylinder to impact a tool, the piston including a first undercut disposed at least partially about a circumferential surface of the piston, wherein the first undercut is provided at a rear end of the piston;

a control valve to control reciprocation of the piston, the control valve alternately connecting a rear driving chamber of the piston to high pressure and low pressure lines, such that when the rear driving chamber is connected to the high pressure line, the piston is driven towards the tool, and wherein the first undercut is provided at a portion of the piston which is rearward of the rear driving chamber of the piston during an entire piston cycle; and a valve pilot line arranged to switch the control valve based on the position of the piston within the cylinder, wherein the valve pilot line is alternately connected, by the reciprocal movement of the piston, to high and low pressure lines via the first undercut in the piston, wherein the first undercut is a portion of the piston having a smaller diameter than adjacent portions of the piston forward and rear of the first undercut, the adjacent portions of the piston forward and rear of the first undercut having a diameter less than the maximum sealing diameter of the piston.

2. A hydraulic percussion device as claimed in claim 1, wherein the first undercut is provided at a portion of the piston which is forward of a rear seal disposed between the piston and the cylinder during the entire piston cycle.

3. A hydraulic percussion device as claimed in claim 1, further comprising:

a port provided in the cylinder for connection of the valve pilot line to the v pressure line via the undercut;

wherein the port further provides seal drainage for a seal disposed between the piston and cylinder.

4. A hydraulic down-the-hole hammer comprising:

a hydraulic percussion device as claimed in claim 1; and a percussion bit.

* * * * *